US007811630B2

(12) United States Patent
Hong et al.

(10) Patent No.: US 7,811,630 B2
(45) Date of Patent: Oct. 12, 2010

(54) ALGAE RESISTANT ROOFING GRANULES WITH CONTROLLED ALGAECIDE LEACHING RATES, ALGAE RESISTANT SHINGLES, AND PROCESS FOR PRODUCING SAME

(75) Inventors: Keith C. Hong, Lititz, PA (US); Husnu M. Kalkanoglu, Swarthmore, PA (US); Ming L. Shiao, Collegeville, PA (US); Anne B. Hardy, Acton, MA (US); James A. Salvatore, Sutton, MA (US); Andrew G. Johnson, Jr., Barre, MA (US)

(73) Assignee: CertainTeed Corporation, Valley Forge, PA (US)

( * ) Notice: Subject to any disclaimer, the term of this patent is extended or adjusted under 35 U.S.C. 154(b) by 1091 days.

(21) Appl. No.: 10/600,809

(22) Filed: Jun. 20, 2003

(65) Prior Publication Data

US 2004/0258835 A1 Dec. 23, 2004

(51) Int. Cl.
*B05D 7/00* (2006.01)

(52) U.S. Cl. ..... 427/212; 427/186; 427/214; 427/219

(58) Field of Classification Search ..... 427/186, 427/212, 214, 219
See application file for complete search history.

(56) References Cited

U.S. PATENT DOCUMENTS

| | | | | |
|---|---|---|---|---|
| 1,677,701 | A | 7/1928 | Alton | 428/404 |
| RE19,372 | E | 11/1934 | Walton | 428/404 |
| 2,001,448 | A | 5/1935 | Beasley | 428/404 |
| RE20,295 | E | 3/1937 | Fisher | 428/145 |
| 2,142,540 | A | 1/1939 | Veazey | 427/219 |
| 2,379,358 | A | 6/1945 | Jewett | 428/145 |
| 2,695,851 | A | 11/1954 | Lodge | 428/404 |
| 2,898,232 | A | 8/1959 | Miller et al. | 427/219 |
| 2,981,636 | A | 4/1961 | Lodge et al. | 428/404 |
| 2,986,476 | A | 5/1961 | Larssen | 427/219 |
| 3,397,073 | A | 8/1968 | Fehner | 428/405 |
| 3,479,201 | A | 11/1969 | Sloan | 428/145 |
| 3,507,676 | A | 4/1970 | McMahon | 428/145 |
| 3,528,842 | A * | 9/1970 | Skadulis | 428/145 |
| 3,752,696 | A | 8/1973 | Beyard et al. | 427/219 |
| 3,932,143 | A | 1/1976 | Marshall et al. | 428/622 |
| 3,945,945 | A | 3/1976 | Kiovsky et al. | 502/355 |

(Continued)

FOREIGN PATENT DOCUMENTS

JP 2002018358 A * 1/2002

(Continued)

OTHER PUBLICATIONS

"The Aging Process of Shingles" by Tyler Wierman, 4 pgs., date unknown, http://www.ag.ohio-state.edu/~ati_cons/257/tyler/1.htm.

(Continued)

*Primary Examiner*—Elena T Lightfoot
(74) *Attorney, Agent, or Firm*—Paul & Paul

(57) ABSTRACT

Algae-resistant roofing granules are formed by extruding a mixture of mineral particles and a binder to form porous granule bodies, and algaecide is distributed in the pores. Release of the algaecide is controlled by the structure of the granules.

22 Claims, 2 Drawing Sheets

U.S. PATENT DOCUMENTS

| | | | | |
|---|---|---|---|---|
| 3,985,540 | A | 10/1976 | Fein et al. | 504/152 |
| 4,092,441 | A | 5/1978 | Meyer et al. | 427/453 |
| 4,631,267 | A | 12/1986 | Lachman et al. | 504/152 |
| 4,735,975 | A * | 4/1988 | Iwata et al. | 523/152 |
| 4,920,090 | A | 4/1990 | Ritter et al. | 427/453 |
| 4,946,505 | A * | 8/1990 | Jungk | 106/712 |
| 5,022,897 | A * | 6/1991 | Balcar et al. | 95/279 |
| 5,039,311 | A | 8/1991 | Bloecher | 502/439 |
| 5,052,162 | A | 10/1991 | Bush et al. | 521/518 |
| 5,147,686 | A | 9/1992 | Ichimura et al. | 427/217 |
| 5,356,664 | A | 10/1994 | Narayan et al. | 427/186 |
| 5,362,566 | A | 11/1994 | George et al. | 427/186 |
| 5,366,767 | A | 11/1994 | Howard | 427/294 |
| 5,411,803 | A | 5/1995 | George et al. | 428/403 |
| 5,599,586 | A | 2/1997 | Israel | 427/299 |
| 5,733,842 | A | 3/1998 | Gerdes et al. | 502/439 |
| 5,975,988 | A | 11/1999 | Christianson | 451/28 |
| 6,063,849 | A | 5/2000 | Morris et al. | 524/432 |
| 6,120,913 | A | 9/2000 | Kluttz et al. | 428/521 |
| 6,214,466 | B1 | 4/2001 | Joedicke | 428/404 |
| 6,235,372 | B1 | 5/2001 | Joedicke | 428/145 |
| 6,238,794 | B1 | 5/2001 | Beesley et al. | 428/403 |
| 6,245,381 | B1 | 6/2001 | Israel | 427/186 |
| 6,306,795 | B1 * | 10/2001 | Ryan et al. | 502/346 |
| 6,495,074 | B1 | 12/2002 | Carr | 264/36.18 |
| 6,521,004 | B1 | 2/2003 | Culler et al. | 51/298 |
| 2002/0095871 | A1 | 7/2002 | McArdle et al. | 51/298 |
| 2002/0098110 | A1 | 7/2002 | Graham et al. | 428/28 |
| 2002/0160151 | A1 | 10/2002 | Pinault et al. | 428/144 |
| 2003/0037698 | A1 | 2/2003 | Kiik et al. | 106/15.05 |
| 2003/0068303 | A1 * | 4/2003 | Selvig et al. | 424/93.1 |
| 2003/0068469 | A1 | 4/2003 | Aschenbeck et al. | 428/150 |
| 2003/0108668 | A1 | 6/2003 | Joekicke | 427/212 |
| 2004/0110639 | A1 | 6/2004 | Joedicke | 504/151 |

FOREIGN PATENT DOCUMENTS

| | | |
|---|---|---|
| WO | WO 96/07538 | 3/1996 |
| WO | 2008045992 A1 | 4/2008 |

OTHER PUBLICATIONS

Technical Bulletin Asphalt Roofing Manufacturers Association "Algae Discoloration of Roofs", Catalogue No. 217-RR-89, 1 pg., (Calverton, MD), May 1997.

Copper Development Association Inc., "Copper Blocks Ugly Bugs", 2 pgs., Winter 1995.

Johns Manville Roofing Systems Group, "Roofing Granules" Sheet ID: 3004, 6 pgs., (Denver, CO), Issued Jan. 11, 2001.

Minerals Research & Recovery, Inc., "Roofing Granules", 2 pgs., (Tucson, AZ), date unknown.

* cited by examiner

ALGAE RESISTANT ROOFING GRANULES WITH CONTROLLED ALGAECIDE LEACHING RATES, ALGAE RESISTANT SHINGLES, AND PROCESS FOR PRODUCING SAME

BACKGROUND OF THE INVENTION

1. Field of the Invention

The present invention relates to asphalt roofing shingles, protective granules for such shingles, and processes for makings such granules and shingles.

2. Brief Description of the Prior Art

Pigment-coated mineral rocks are commonly used as color granules in roofing applications to provide aesthetic as well as protective functions to the asphalt shingles. Dark blotches or streaks sometimes appear on the surfaces of asphalt shingles, especially in warmer humid climates, as a result of the growth of algae and other microorganisms. The predominant species responsible is *Gloeocapsa magma*, a blue green algae. Eventually, severe discoloration of the entire roof can occur.

Various methods have been used in an attempt to remedy the roofing discoloration. For example, topical treatments with organic algaecides have been used. However, such topical treatments are usually effective only for short term, typically one to two years. Another approach is to add algaecidal metal oxides to the color granule coatings. This approach is likely to provide longer protection, for example, as long as ten years.

Companies, including Minnesota Mining and Manufacturing (3M) and GAF Materials Corporation/ISP Mineral Products Inc., have commercialized several algaecide granules that are effective in inhibiting algae growth.

A common method used to prepare algae-resistant (AR) roofing granules generally involves two major steps. In the first step, metal oxides such as cuprous oxide and/or zinc oxide are added to a clay and alkali metal silicate mixture that in turn is used to coat crushed mineral rocks. The mixture is rendered insoluble on the rock surfaces by firing at high temperatures, such as about 500° C., to provide a ceramic coating. In the second step, the oxides covered rocks are coated with various color pigments to form colored algae-resistant roofing granules. The algae-resistant granules, alone, or in a mixture with conventional granules, are then used in the manufacture of asphalt shingles using conventional techniques. The presence of the algae-resistant granules confers algae-resistance on the shingles.

Roofing granules typically comprise crushed and screened mineral materials, which are subsequently coated with a binder containing one or more coloring pigments, such as suitable metal oxides. The binder can be a soluble alkaline silicate that is subsequently insolubilized by heat or by chemical reaction, such as by reaction between an acidic material and the alkaline silicate, resulting in an insoluble colored coating on the mineral particles.

U.S. Pat. No. 3,507,676 discloses roofing granules containing zinc, zinc oxide, or zinc sulfide, as an algaecide and fungicide.

Algae resistant shingles are disclosed, for example, in U.S. Pat. No. 5,356,664 assigned to Minnesota Mining and Manufacturing Co., which discloses the use of a blend of algae-resistant granules and non-algae-resistant granules. The algae-resistant granules have an inner ceramic coating comprising cuprous oxide and an outer seal coating initially devoid of copper.

There is a continuing need for algae-resistant roofing products having algaecide leaching rates that can be controlled so that the roofing products can be tailored for specific local conditions.

SUMMARY OF THE INVENTION

The present invention provides algae-resistant roofing granules having algaecide leaching rates that can be easily controlled, and asphalt shingle roofing products incorporating such algae-resistant roofing granules.

The present invention employs mineral particles to form algae-resistant roofing granules. In contrast to prior processes for forming algae-resistant granules, which typically use crushing to achieve mineral material having an average size and size range suitable for use in manufacturing asphalt roofing shingles, the process of the present invention employs mineral particles having an average size smaller than that suitable for use in manufacturing asphalt roofing shingles. These mineral particles are aggregated to provide suitably sized roofing granules.

The mineral particles are treated with a suitable binder, such as a clay binder, and the mixture of mineral particles and binder is processed using a suitable mechanical technique, such as extrusion, to form porous granule bodies that are of a size suitable for use in manufacturing asphalt roofing shingles, such from sub-millimeter size up to about 2 mm. The granule bodies can be fired or sintered to provide physical strength.

The binder and the mechanical forming process are selected to provide algae-resistant roofing granules that are sufficiently porous to permit leaching of algaecide to provide the desired algaecidal properties. Porosity is preferably between about 3% and about 30% by volume.

Several techniques can be used to introduce algaecides into the granule bodies. Metal oxides, including cuprous oxide and zinc oxide, are especially preferred as inorganic algaecides, because of their favorable cost/performance aspects. Inorganic algaecides that are only slightly soluble in water are preferred, so that such algaecides will slowly leach from the granules thereby providing algae-resistance to the granules and the roofing products in which such granules have been embedded.

The algaecide can be optionally included in the mixture of mineral particles and binder before the granule bodies are formed.

Alternatively, the algaecide can be incorporated after the granule bodies have been formed. For example, the granule bodies can be optionally coated with at least one intermediate coating binder, such as an alkali metal silicate, optionally including one or more algaecides. The intermediate coating binder is preferably different from that employed in forming the granule bodies. The intermediate coating binder can then be optionally cured, such as by chemical treatment or heat treatment (e.g. firing).

In another alternative, the porous granule bodies are immersed in an algaecide solution, such as an aqueous solution of a soluble copper salt, such as cupric chloride, and the algaecide solution is drawn into the porous granule bodies by capillary action. Subsequently, the algaecide solution-laden granule bodies can be treated, as by heating, to dry the granule bodies, and to convert the soluble algaecide into a less soluble form. For example, the granule bodies can be heated according to a predetermined protocol to convert a soluble copper salt, such as cupric nitrate, to a copper oxide, such as cuprous oxide.

In another alternative for incorporating the algaecide in the porous granule bodies, the porous granule bodies are immersed in a slurry formed with fine particles of an algaecide, such as cuprous oxide, and the slurry is drawn into the pores of the granule bodies by capillary action. In the alternative, pressure or vacuum can be applied to force or draw the algaecide into the pores of the granule bodies. The algaecide-laden granule bodies are then dried.

Various combinations of the above-described alternatives for introducing algaecide into and/or on the granule bodies can also be employed to achieve desired algaecide leach rates and leaching profiles. For example, a first proportion of a first algaecide can be incorporated in the binder used to aggregate the mineral particles, and a second algaecide can be introduced into pores formed in the granule bodies.

The granule bodies can be optionally coated with a colorant coating, the colorant coating including a binder, such as an alkali metal silicate, clay, and one or more colorant materials, such as a suitable metal oxide pigment. The colorant coating can then be insolubilized.

Preferably, the intermediate particles are coated with the optional intermediate coating and the colorant coating before the binder is insolubilized.

By adjusting the porosity of the granule bodies, and the nature and amounts of algaecide in the intermediate particle binder and the intermediate coating binder, the algaecidal resistance properties of the algae-resistant granules can be varied.

Preferably, the metal oxide concentration ranges from 0.1% to 7% of the total granules weight.

The algae-resistant granules prepared according to the process of the present invention can be employed in the manufacture of algae-resistant roofing products, such as algae-resistant asphalt shingles. The algae-resistant granules of the present invention can be mixed with conventional roofing granules, and the granule mixture can be embedded in the surface of bituminous roofing products using conventional methods. Alternatively, the algae-resistant granules of the present invention can be substituted for conventional roofing granules in manufacture of bituminous roofing products, such as asphalt roofing shingles, to provide those roofing products with algae-resistance.

It is thus an object of the present invention to provide a process for preparing AR roofing granules having a controllable algaecide-leaching rate.

It is also an object of the present invention to provide a process for preparing roofing shingles to have algae-resistance that can be customized to the specific geographic region in which the shingles are intended to be used.

It is a further object of the present invention to provide algae-resistant roofing granules having controllable levels of algaecide release.

It is a further object of the present invention to provide algae resistant asphalt shingles.

These and other objects of the invention will become apparent through the following description and claims.

DETAILED DESCRIPTION

The mineral particles employed in the process of the present invention are preferably chemically inert materials. The mineral particles preferably have an average particle size of from about 0.1 μm to about 40 μm, and more preferable from about 0.25 μm to about 20 μm. Stone dust can be employed as the source of the mineral particles in the process of the present invention. Stone dust is a natural aggregate produced as a by-product of quarrying, stone crushing, machining operations, and similar operations. In particular, dust from limestone, marble, syenite, diabase, greystone, quartz, slate, trap rock, and/or basalt can be used. Ceramic materials, such as silicon carbide and aluminum oxide of suitable dimensions can also be used.

The binder employed in the process of the present invention is preferably a heat reactive aluminosilicate material, such as clay, preferably, kaolin. The bodies are preferably formed from a mixture of mineral particles and binder, ranging from about 95% by weight binder to less than about 10% by weight binder, and the bodies preferably are formed from a mixture that includes from about 10% to 40% by weight binder.

When the formed granules are fired at an elevated temperature, such as at least 800 degrees C., and preferably at 1,000 to 1,200 degrees C., the clay binder densifies to form strong particles.

Examples of clays that can be employed in the process of the present invention include kaolin, other aluminosilicate clays, Dover clay, bentonite clay, etc.

The algae-resistant roofing granules of the present invention can be colored using conventional coatings pigments. Examples of coatings pigments that can be used include those provided by the Color Division of Ferro Corporation, 4150 East 56th St., Cleveland, Ohio 44101, and produced using high temperature calcinations, including PC-9415 Yellow, PC-9416 Yellow, PC-9158 Autumn Gold, PC-9189 Bright Golden Yellow, v-9186 Iron-Free Chestnut Brown, V-780 Black, V0797 IR Black, V-9248 Blue, PC-9250 Bright Blue, PC-5686 Turquoise, V-13810 Red, V-12600 Camouflage Green, V12560 IR Green, V-778 IR Black, and V-799 Black.

In the initial step of the process of the present invention, porous base particles are provided. Particle synthesis allows properties of the algae-resistant granules to be tailored, such as the porosity and distribution of the algaecide, such as copper oxide. The base particles are preferably prepared by mixing mineral particles with a suitable binder, such as a binder comprising an aluminosilicate material, such as clay (which is also, formally, composed of "mineral particles," but not as that term is used herein), as is shown schematically in FIG. 4. The mixture is then formed into base particles, using a forming process such as press, molding, cast molding, injection molding, extrusion, spray granulation, gel casting, pelletizing, compaction, or agglomeration. Preferably, the resulting base particles have sizes between about 500 μm and 2 mm.

Figure 4:
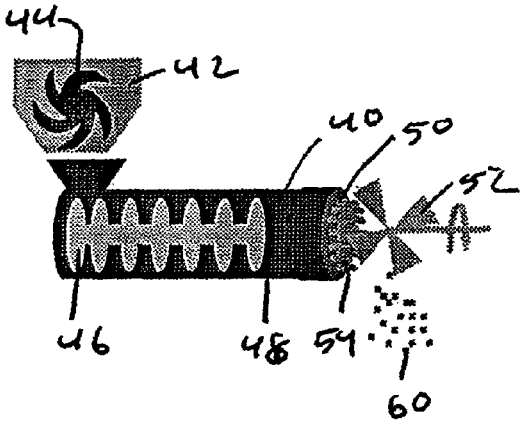
FIG. 4 is a schematic representation of the process of the present invention.

As shown schematically in FIG. 4, the process of the present invention can employ a conventional extrusion apparatus 40. Kaolin clay, mineral particles and water (to adjust mixability) can be charged to a hopper 42, and mixed by a suitable impeller 44 before being fed to an extrusion screw 46 provided in the barrel 48 of the extrusion apparatus. The screw 46 forces the mixture through a plurality of apertures 50 having a predetermined dimension suitable for sizing roofing granules. As the mixture is extruded, the extrudate 54 is chopped by a suitable rotating knives 52 into a plurality of base particles 60, which are subsequently fired at an elevated temperature to sinter or densify the binder.

In addition, the present process comprises providing at least one inorganic algaecide on or within the base particle to form algaecide-bearing particles. Preferably, in one embodiment of the process of the present invention, the at least one inorganic algaecide is mixed with the binder and the mineral particles before the mixture is formed into the base particles. In the alternative, or in addition, the formed base particles can be coated with a mixture of algaecide and binder.

In another alternative, the base particles are formed from the mineral particles and the binder, and fired at an elevated temperature to provide inert, porous, fired base particles. The porous base particles can then be treated with a solution of a soluble algaecide, such as an aqueous solution of a water-soluble copper salt, such as cupric nitrate or cuprous chloride, which is drawn into the porous base particles by capillary action, to form algaecide solution-laden particles. The solution-laden particles can then be treated, as by drying. Optionally, the solution-laden base particles are treated to convert the soluble algaecide to a less soluble form. For example, when the soluble algaecide is a soluble copper salt, the solution-laden particles can be treated by heating to convert the soluble copper salt into a copper oxide, such as cuprous oxide, a less soluble inorganic algaecide.

Alternatively, the porous base particles can be mixed with a slurry of algaecide-forming compound, the slurry being drawn into the pores in the base particles by capillary action to form slurry-laden particles. The slurry-laden particles can then be subsequently treated to convert the algaecide-forming compound into an inorganic algaecide.

The at least one algaecide is preferably selected from the group consisting of copper materials, zinc materials, and mixtures thereof. The copper materials can include cuprous oxide, cupric acetate, cupric chloride, cupric nitrate, cupric oxide, cupric sulfate, cupric sulfide, cupric stearate, cupric cyanide, cuprous cyanide, cuprous stannate, cuprous thiocyanate, cupric silicate, cuprous chloride, cupric iodide, cupric bromide, cupric carbonate, cupric fluoroborate, and mixtures thereof. The zinc materials can include zinc oxide, such as French process zinc oxide, zinc sulfide, zinc borate, zinc sulfate, zinc pyrithione, zinc ricinoleate, zinc stearate, zinc chromate, and mixtures thereof. Preferably, the at least one algaecide is cuprous oxide and zinc oxide.

The algaecide resistance properties of the algaecide resistant roofing granules of the present invention are determined by a number of factors, including the porosity of the roofing granules, the nature and amount(s) of the algaecide employed, and the spatial distribution of the algaecide within the granules.

The process of the present invention advantageously permits the algae resistance of the shingles employing the algae-resistant granules to be tailored to specific local conditions. For example, in geographic areas encumbered with excessive moisture favoring rapid algae growth, the granules can be structured to release the relatively high levels of algaecide required to effectively inhibit algae growth under these conditions. Conversely, where algae growth is less favored by local conditions, the granules can be structured to release the lower levels of algaecide effective under these conditions.

The algae resistance properties of the granule bodies can also be varied through control of the porosity conferred by the binder employed. For example, the binder porosity can be controlled by adjusting the ratio of the mineral particles and the aluminosilicate employed, as well as by the heat treatment applied. Also, porosity can be induced by using an additive that burns off or produces gaseous products that are subsequently entrained in the structure of the granule bodies.

The porosity of the granule bodies can also be controlled by selection of the shape and particle size distribution of the mineral particles provided. For example, by selecting mineral particles known to pack poorly, the porosity can be increased.

Combinations of the above-described alternatives for introducing algaecide into and/or on the granule bodies can also be employed. By adjusting the amount and selecting the type of algaecide used, and by adjusting the porosity of the granules, a variety of different algaecide leach rates and leaching profiles can be obtained.

For example, a first algaecide can be incorporated in the binder used to aggregate the mineral particles, and a second algaecide, less soluble than the first algaecide, can be introduced into pores formed in the granule bodies. The spatial distribution of the first algaecide within the binder will tend to provide a lower leaching rate compared with the spatial distribution of the second algaecide, located in the pores, and tend to compensate for the difference in solubility, so that a desired leach profile can be achieved.

Figure 1:
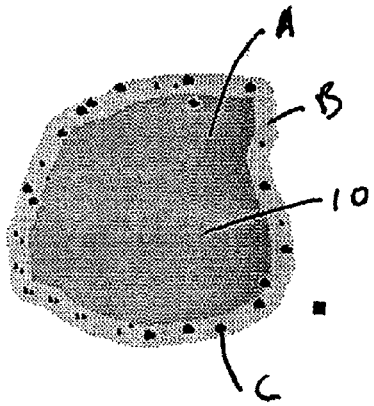
FIG. 1 is a schematic representation of a first type of an algae-resistant granule prepared according to the process of the present invention.
Figure 2:
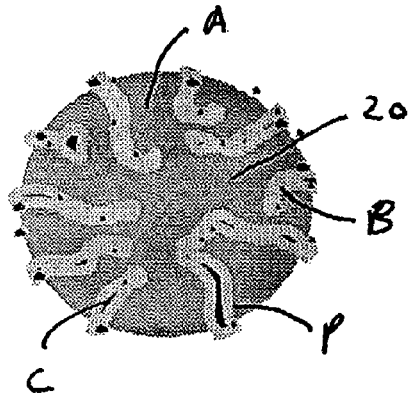
FIG. 2 is a schematic representation of a second type of an algae-resistant granule prepared according to the process of the present invention.
Figure 3:
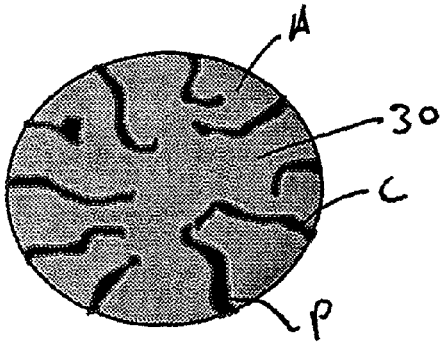
FIG. 3 is a schematic representation of a third type of an algae-resistant granule prepared according to the process of the present invention.

FIGS. 1, 2 and 3 schematically illustrate examples of algae-resistant granules prepared according to the process of the present invention and exhibiting three distinct morphologies. FIG. 1 schematically illustrates an algae-resistant granule 10 formed from a base particle A covered with a coating of a binder B in which are distributed algaecide particles C. The base particle A is formed from mineral particles bound together with a binder (not shown individually). This type of algae-resistant granule 10 can be formed by initially preparing an inert base particle from mineral particles and binder as described above, and then covering the base particle with a coating of binder containing algaecide.

FIG. 2 schematically illustrates an algae-resistant granule 20 formed from a base particle A having a plurality of pores P, the pores being filled with a binder B in which are distributed algaecide particles C. The base particle A is also formed from mineral particles bound together with a binder (not shown individually). This type of algae-resistant granule 20 can be formed by preparing a base particle from mineral particles and binder containing algaecide.

FIG. 3 schematically illustrates an algae-resistant granule 30 formed from a base particle A having a plurality of pores P, the surfaces of the pores P having deposited thereon a plurality of algaecide particles C. This type of algae-resistant granule 30 can be formed by initially preparing an inert base particle from mineral particles and binder as described above, and then infiltrating the pores with a aqueous solution of a water-soluble algaecide such as cupric nitrate, and then drying the particle. When the algaecide is a water-soluble copper salt, such as cupric nitrate, the particle can be fired at an elevated temperature to convert copper salt successively to cupric oxide and then to cuprous oxide, which is advantageously less soluble than cupric oxide.

Figure 5:
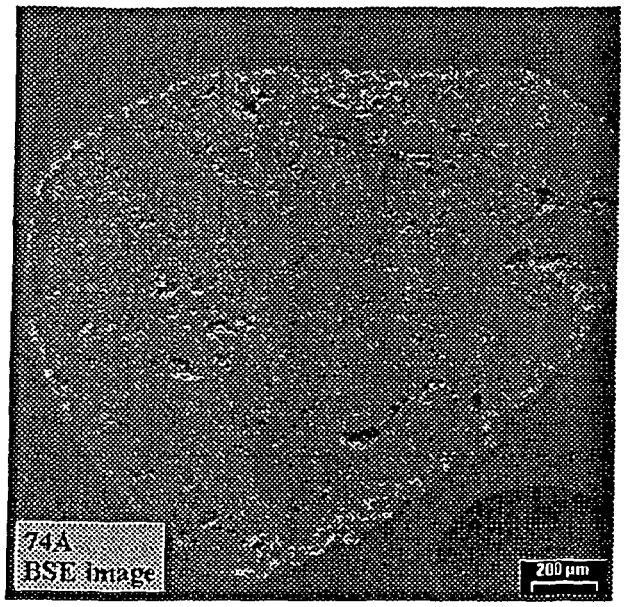
FIG. 5 is an electron micrograph showing a cross-sectional view of a first algae-resistant granule prepared according to the process of the present invention.
Figure 6:
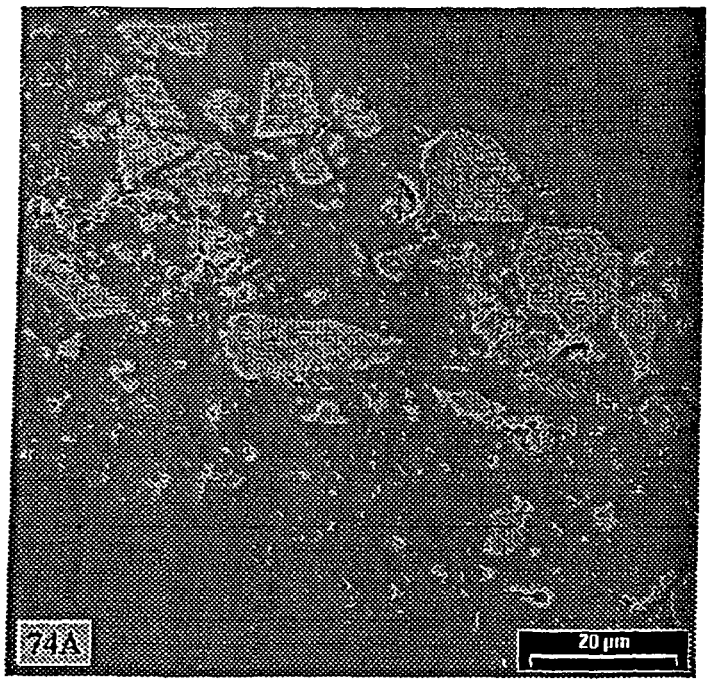
FIG. 6 is an electron micrograph showing a cross-sectional view of a second algae-resistant granule prepared according to the process of the present invention.

FIGS. 5 and 6 are electron micrographs of algae-resistant granules prepared according to the process of the present invention showing pores and included copper oxide.

The algae-resistant granules prepared according to the process of the present invention can be employed in the manufacture of algae-resistant roofing products, such as algae-resistant asphalt shingles, using conventional roofing production processes. Typically, bituminous roofing products are sheet goods that include a non-woven base or scrim formed of a fibrous material, such as a glass fiber scrim. The base is coated with one or more layers of a bituminous material such as asphalt to provide water and weather resistance to the roofing product. One side of the roofing product is typically coated with mineral granules to provide durability, reflect heat and solar radiation, and to protect the bituminous binder from environmental degradation. The algae-resistant granules of the present invention can be mixed with conventional roofing granules, and the granule mixture can be embedded in the surface of such bituminous roofing products using conventional methods. Alternatively, the algae-resistant granules of the present invention can be substituted for conventional roofing granules in manufacture of bituminous roofing products to provide those roofing products with algae-resistance.

Bituminous roofing products are typically manufactured in continuous processes in which a continuous substrate sheet of a fibrous material such as a continuous felt sheet or glass fiber mat is immersed in a bath of hot, fluid bituminous coating material so that the bituminous material saturates the substrate sheet and coats at least one side of the substrate. The reverse side of the substrate sheet can be coated with an anti-stick material such as a suitable mineral powder or a fine sand. Roofing granules are then distributed over selected portions of the top of the sheet, and the bituminous material serves as an adhesive to bind the roofing granules to the sheet when the bituminous material has cooled. The sheet can then be cut into conventional shingle sizes and shapes (such as one foot by three feet rectangles), slots can be cut in the shingles to provide a plurality of "tabs" for ease of installation, additional bituminous adhesive can be applied in strategic locations and covered with release paper to provide for securing successive courses of shingles during roof installation, and the finished shingles can be packaged. More complex methods of shingle construction can also be employed, such as building up multiple layers of sheet in selected portions of the shingle to provide an enhanced visual appearance, or to simulate other types of roofing products.

The bituminous material used in manufacturing roofing products according to the present invention is derived from a petroleum processing by-product such as pitch, "straight-run" bitumen, or "blown" bitumen. The bituminous material can be modified with extender materials such as oils, petroleum extracts, and/or petroleum residues. The bituminous material can include various modifying ingredients such as polymeric materials, such as SBS (styrene-butadiene-styrene) block copolymers, resins, oils, flame-retardant materials, oils, stabilizing materials, anti-static compounds, and the like. Preferably, the total amount by weight of such modifying ingredients is not more than about 15 percent of the total weight of the bituminous material. The bituminous material can also include amorphous polyolefins, up to about 25 percent by weight. Examples of suitable amorphous polyolefins include atactic polypropylene, ethylene-propylene rubber, etc. Preferably, the amorphous polyolefins employed have a softening point of from about 130 degrees C. to about 160 degrees C. The bituminous composition can also include a suitable filler, such as calcium carbonate, talc, carbon black, stone dust, or fly ash, preferably in an amount from about 10 percent to 70 percent by weight of the bituminous composite material.

The following examples are provided to better disclose and teach processes and compositions of the present invention. They are for illustrative purposes only, and it must be acknowledged that minor variations and changes can be made without materially affecting the spirit and scope of the invention as recited in the claims that follow.

EXAMPLE 1

634 g of stone dust from rhyolite igneous rock (Wrentham, Mass.) are mixed for 20 minutes in a Hobart mixer with 1901 g of kaolin clay (Cedar Heights Clay Co., Oak Hill, Ohio), 44 g of cuprous oxide (American Chemet Corporation, Deerfield, Ill.) and 2.2 g of Kadox—brand zinc oxide (Zinc Corporation of America, Monaca, Pa.). The mixture is then extruded using a single barrel extruder to form green granules having an average particle size of about 2.5 mm. The green granules are then fired in a Blue M periodic oven (Lunaire Limited, Williamsport, Pa.) at a temperature of 1050 degrees C. for 180 minutes.

EXAMPLE 2

The process of Example 1 is repeated, except that 500 g of the fired granules are coated with a colorant mixture of 15 g of pigment particles (V-780, Ferro Corporation), 40 g of aqueous sodium silicate (40 percent by weight solids, having a $Na_2O:SiO_2$ ratio of 1:3.2), and 30 g of kaolin clay. 0.152 g of coating mixture are applied per g of granule. The coated granules are subsequently fired in a rotary kiln at 500 degrees C. for 20 minutes.

EXAMPLE 3

The process of Example 1 is repeated, except that 500 g of fired granules are coated with an algaecide mixture of 17 g of cuprous oxide, 1.1 g of zinc oxide, 60 g of the aqueous sodium silicate employed in Example 2, and 45 g of kaolin clay. 0.246 g of the algaecide mixture are applied per g of granules to form algaecide-coated granules. The algaecide-coated granules are further coated with a colorant coating mixture employed in Example 2, except that 6 g of pigment particles, 16 g of sodium silicate, and 10 g of kaolin clay are used. The resulting coated granules are subsequently fired in a rotary kiln at 400 degrees C. for 20 minutes.

EXAMPLE 4

The process of Example 1 is repeated, except that 500 g of the granules are coated with an intermediate coating mixture of 20 g of the aqueous sodium silicate employed in Example 2, and 15 g of kaolin clay. 0.07 g of the intermediate coating mixture are applied per g of granules to form algaecide-laden granules. The algaecide-laden granules are further coated with a colorant coating mixture employed in Example 2, except that 6 g of pigment particles, 20 g of sodium silicate, and 15 g of kaolin clay are used. The resulting particles are subsequently fired in a rotary kiln at 500 degrees C. for 20 minutes.

EXAMPLE 5

634 g of stone dust from rhyolite igneous rock form Wrentham, Mass., are mixed with 1901 g of Cedar Heights Goat Hill Clay #30 and 422 g of deionized water in a Hobart mixer for 20 minutes. The mixture is then extruded using a single barrel screw extruder through a die with plurality of holes and subsequently chopped into granules having an average particle size of about 2.3 mm. The green granules are then dried at 80 degrees C. overnight and fired in a periodic oven (manufacturer Blue M) to a temperature of 1200 degrees C. for 3 hours.

EXAMPLE 6

2310 g of stone dust are mixed with 770 g of Cedar Heights Goat Hill Clay #30 and 420 g of deionized water in a Hobart mixer for 20 minutes. The mixture is then extruded using a single barrel screw extruder through a die with plurality of holes and subsequently chopped into granules having an average particle size of about 2.3 mm. The green granules are then dried at 80 degrees C. overnight and fired in a periodic oven (Lindberg) to a temperature of 1120 degrees C. for 2 hours.

EXAMPLE 7

72.64 kg of stone dust is mixed with 18.16 kg of KT Clay Tenn. SGP clay, 182 g of Allbond 200 Progel Corn Flour (Lauhoff Grain Company, St. Louis, Mo.), and 422 g of deionized water in a Lodige mixer (Gebr. Lodige Maschinenbau GmbH, Paderborn, Germany). The mixture is then extruded using a piston extruder through a die with a plurality of holes and subsequently chopping into granules having an average particle size of about 1.78 mm. The green granules are then dried at 105 degrees C. overnight and fired in a rotary kiln set to a temperature of 1085 degrees C.

EXAMPLE 8

The process of Example 7 is repeated, except that 500 g of the fired granules are coated with an algaecide mixture of 17 g of cuprous oxide, 0.9 g of zinc oxide, 16 g of the aqueous sodium silicate employed in Example 2, and 10 g of kaolin clay. 0.088 g of the algaecide mixture are applied per gram of granule to form algaecide-coated granules. The algaecide-coated granules are further coated with a colorant coating mixture as in Example 2 and the resulting coated green granules are subsequently fired as provided in Example 2.

EXAMPLE 9

The process of Example 7 is repeated, except that after firing the granules, 500 g of the granules are coated with a colorant mixture of 6 g of pigment particles (V-780, Ferro Corporation), 16 g of the aqueous sodium silicate employed in Example 2, and 10 g of kaolin clay. 0.0064 g of coating mixture are applied per gram of granule. The coated granules are subsequently fired as provided in Example 2.

EXAMPLE 10

352 g of stone dust are mixed with 352 g of Cedar Heights Goat Hill Clay #30 and 120 g of deionized water in a Hobart mixer for 20 minutes. The mixture is then extruded using a single barrel screw extruder through a die with plurality of holes and subsequently chopped into granules having an average particle size of about 2.3 mm. The green granules are then dried at 80 degrees C. overnight and fired in a periodic oven (manufacturer Blue M) to a temperature of 1100 degrees C. for 2 hours. A copper nitrate solution was made with 100 g of copper nitrate dissolved in 100 g of deionized water. Twenty-five grams of the fired granules were tumbled in Nalgene jar with 10 ml of the copper nitrate solution. The granules were separated from the remaining solution using a Buchner funnel and filter paper, and the granules are dried in an 80 degree C. drying oven overnight. The resulting granules contain about 6% by weight copper nitrate. The copper nitrate laden granules are then fired to 1050 degrees C. for 2 hours to convert the copper nitrate into copper oxide. Resulting granules are shown in the micrographs of FIGS. 5 and 6.

EXAMPLE 11

The process of Example 6 is repeated, except that the undried green granules are shaken in a container with 3 g of cuprous oxide powder, effectively coating the surface of the granules with cuprous oxide powder. The resultant undried green granules are subsequently dried and fired as provided in Example 6.

EXAMPLE 12

The process of Example 11 is repeated, except that cuprous-oxide laden granules are coated using 500 g with a colorant mixture of 6 g of pigment particles (V-780 Ferro Corporation), 16 g of the aqueous sodium silicate employed in Example 2, and 10 g of kaolin clay. 0.064 g of coating mixture is applied per gram of green granule. The coated granules are subsequently fired as provided in Example 2.

Various modifications can be made in the details of the various embodiments of the processes, compositions and articles of the present invention, all within the scope and spirit of the invention and defined by the appended claims.

We claim:

1. A process for producing algae-resistant roofing granules, the process comprising:

(a) preparing porous, inert base particles from a mixture including stone dust and a binder;

(b) providing at least one inorganic algaecide on or within the base particles to form algaecide-bearing particles;

(c) insolubilizing the binder.

2. A process according to claim 1 wherein the mixture is formed into base particles by a forming process selected from press molding, cast molding, injection molding, extrusion, spray granulation, gel casting, pelletizing, compaction and agglomeration.

3. A process according to claim 1 wherein the at least one inorganic algaecide is provided on the base particle by coating the base particle with the at least one inorganic algaecide.

4. A process according to claim 1 wherein the at least one inorganic algaecide is selected from the group consisting of copper materials, zinc materials, and mixtures thereof.

5. A process according to claim 4 wherein the inorganic algaecides are cuprous oxide and zinc oxide.

6. A process according to claim 1 wherein the binder comprises an aluminosilicate material, and the base particles are fired in a kiln at a temperature of from 800 degrees C. to 1200 degrees C. to insolubilize the binder.

7. A process according to claim 6 wherein the at least one inorganic algaecide is provided in the base particles after the base particles are fired, an algaecide-forming compound being dissolved in a fluid to form a solution, the solution being drawn into the pores in the base particles by capillary action to form solution-laden particles, the solution-laden particles being subsequently treated to convert the algaecide-forming compound to an inorganic algaecide.

8. A process according to claim 7 wherein the algaecide-forming compound is a soluble copper salt, and the solution-laden particles are subsequently treated by heating the particles to convert the soluble copper salt to cuprous oxide.

9. A process according to claim 6 wherein the at least one inorganic algaecide is provided in the base particles after the base particles are fired, an algaecide-forming compound being mixed with a binder and a fluid to form a slurry, the slurry being drawn into the pores in the base particles by capillary action to form slurry-laden particles, the slurry-laden particles being subsequently treated to convert the algaecide-forming compound to an inorganic algaecide.

10. A process according to claim 9 wherein the algaecide-forming compound is a soluble copper salt, and the slurry-laden particles are subsequently treated by heating the particles to convert the soluble copper salt to cuprous oxide.

11. A process according to claim 1 further comprising coating the algaecide-bearing particles with a colorant composition.

12. A process according to claim 11 wherein the colorant composition includes a fusible binder, and further comprising heating the colorant-coated algaecide-bearing particles to fuse the binder.

13. A process according to claim 1 wherein the roofing granules have a porosity of between about 3 percent and 30 percent by volume.

14. A process according to claim 1 wherein the mixture includes from about 10 percent to 40 percent by weight binder.

15. Roofing granules prepared according to the process of claim 1.

16. A process for producing algae-resistant roofing granules, the process comprising:

(a) preparing porous, inert base particles from a mixture including stone dust and from about 10 percent to 40 percent by weight of a binder comprising an aluminosilicate material;

(b) providing at least one inorganic algaecide within the base particles to form algaecide-bearing particles;

(c) insolubilizing the binder by firing the base particles in a kiln at a temperature of from 800 degrees C. to 1200 degrees C.;

the roofing granules having a porosity of between about 3 percent and 30 percent by volume.

17. Roofing granules prepared according to the process of claim 16.

18. A process according to claim 1 wherein the porosity of the inert base particles is controlled by selection of the shape of the stone dust.

19. A process according to claim 1 wherein the porosity of the inert base particles is controlled by selection of the particle size distribution of the stone dust.

20. A process according to claim 16 wherein the porosity of the inert base particles is controlled by selection of the shape of the stone dust.

21. A process according to claim 16 wherein the porosity of the inert base particles is controlled by selection of the particle size distribution of the stone dust.

22. A process according to claim 16 wherein the porosity of the inert base particles is controlled by adjusting the ratio of stone dust and aluminosilicate material.

* * * * *